United States Patent [19]

Nakamura

[11] Patent Number: 4,610,357

[45] Date of Patent: Sep. 9, 1986

[54] DISPENSER-CONTAINER CONTAINING WET AND DRY CONTENTS AND PROCESS FOR MANUFACTURING THE SAME

[76] Inventor: Kenji Nakamura, 3-7, Nishiawaji 6-chome, Higashiyodogawa-ku, Osaka, Japan

[21] Appl. No.: 731,836

[22] Filed: May 8, 1985

Related U.S. Application Data

[63] Continuation-in-part of Ser. No. 585,629, Mar. 7, 1984, which is a continuation of Ser. No. 388,963, Jun. 16, 1982, abandoned, which is a continuation of Ser. No. 210,682, Nov. 26, 1980, abandoned.

[30] Foreign Application Priority Data

Feb. 26, 1985 [JP] Japan ..... 60-37074
Feb. 26, 1985 [JP] Japan ..... 60-27024[U]

[51] Int. Cl.[4] ..... B65D 81/24

[52] U.S. Cl. ..... 206/449; 206/607; 206/613; 206/621; 206/629; 206/813; 206/494

[58] Field of Search ..... 206/205, 613, 607, 629, 206/621, 631, 632, 633, 812, 813, 494; 229/62; 220/258

[56] References Cited

U.S. PATENT DOCUMENTS

| | | | |
|---|---|---|---|
| 3,438,565 | 4/1969 | Lunt et al. | 206/613 |
| 3,580,466 | 5/1971 | Thelen et al. | 206/607 |
| 3,819,043 | 6/1974 | Harrison | 206/449 |
| 3,851,762 | 12/1974 | Liblick | 206/813 |
| 3,951,331 | 4/1976 | Smith et al. | 220/258 |
| 4,131,195 | 12/1978 | Worrell, Sr. | 206/205 |
| 4,192,420 | 3/1980 | Worrell, Sr. et al. | 220/258 |
| 4,458,810 | 7/1984 | Mahoney | 206/494 |
| 4,487,318 | 12/1984 | Roen | 206/494 |

*Primary Examiner*—Joseph Man-Fu Moy
*Attorney, Agent, or Firm*—Burgess, Ryan & Wayne

[57] ABSTRACT

A dispenser-container containing wet and dry contents comprising:

wet fibrous materials contained in an inner container made of a gas impervious sheet;

the inner container having an opening for dispensing the wet fibrous materials therethrough or a weakened line for forming the opening;

the opening or weakened line resealably covered by a flexible flap which is repeatedly attached to or removed from the inner container by means of an pressure sensitive adhesive;

both the inner container containing wet fibrous materials and materials in a dry condition contained in an outer container while they are stacking with each other, the outer container having a first opening or a first weakened line for forming the first opening formed in a first surface at a portion coinciding with the opening or the weakened line formed in the inner container; and the outer container having a second opening for dispensing the dry materials or a second weakened line for forming the second opening in a second surface opposite to the first surface having the first opening or the first weakened line.

11 Claims, 25 Drawing Figures

DISPENSER-CONTAINER CONTAINING WET AND DRY CONTENTS AND PROCESS FOR MANUFACTURING THE SAME

CROSS REFERENCE TO RELATED APPLICATIONS

This application is a Continuation-in-Part Application of United States Ser. No. 585,629, filed on Mar. 7, 1984, which is a Continuation Application of United States Ser. No. 388,963, file on June 16, 1982 and now abandoned, which is a Continuation Application of United States Ser. No. 210,682, filed Nov. 26, 1980 and now abandoned.

BACKGROUND OF THE INVENTION

1. Field of the Invention

The present invention relates to a dispenser-container containing wet and dry contents, especially, wet contents required to be hermetically sealed and the dry contents which do not require to be hermetically sealed. The present invention also relates to a process for manufacturing the dispenser-containers.

In particular, the present invention relates to a dispenser-container suitable for containing fibrous materials wetted with cosmetic in a liquid or milky lotion state, which materials are required to be hermetically sealed together with fibrous materials in a dry condition, which materials do not need to be hermetically sealed. The contained fibrous materials can be individually dispensed from the dispenser-container, and the dispenser-container is able to repeatedly and reliably seal, especially the fibrous materials wetted with cosmetic, which materials need to be hermetically sealed.

2. Description of the Prior Art

Recently, fibrous materials, for example, non-woven fabrics have been utilized widely for cleaning skin or for make-up, the fibrous materials being impregnated with cosmetic, containing alcohol, moisturizing agent, surfactant and so on, and having a cleaning effect. Such fibrous materials impregnated with toilet water are packed in a cylindrical container or in a small dispenser-container for portable use.

Further, a small dispenser-container containing non-woven fabrics impregnated with carmine lotion is used for a portable toilet article.

Such small dispenser-containers containing fibrous materials impregnated with cosmetic as described above are convenient for portable use. Upon make up, fibrous materials in a dry condition, such as a cut cotton layer for toilet use or tissue papers, are simultaneously used, and therefore, it will be more convenient if fibrous materials impregnated with cosmetic and fibrous materials in a dry condition can be carried together.

Besides, conventionally sold under the trademark "Band-Aid" and well used is a small prepared bandage of gauze and adhesive tape for small wounds, such as for a cut or an abrasion. The bandage can be readily used for treating a cut or abrasion and is particularly very convenient for treating a cut or abrasion of a small child.

However, a child may easily slip and fall and is often injured while he or she is playing in the open air. In such a case, mud often adheres to a wound, and accordingly, a band-aid cannot be applied to the wound until the mud is removed or the wound is disinfected.

Under the situations described above, a product, in which a band-aid and a gauze or cotton impregnated with disinfectant are combined together and which is portable, may be convenient for the treatment of a wound in the open air. However, such a product has not been manufactured nor sold.

The present applicant previously proposed in Japanese Patent Publication No. Sho 58-41842 a dispenser-container for toilet use, in which wet and dry contents can be contained and by which wet contents can be repeatedly resealed. In this dispenser-container containing wet and dry contents, three sheets are superposed, and the peripheries of the sheets are sealed while the contents to be contained are inserted into spaces between the sheets. Openings are formed in the outer two sheets, respectively, of the three sheets for dispensing the contents therethrough, and the opening formed in one of the outer sheets is formed in an outer sheet and is covered by a flap having pressure sensitive adhesive applied thereon.

In the conventionally known dispenser-container containing wet and dry contents, one of the compartments has an flap, and therefore, it is suitable for containing fibrous materials impregnated with cosmetic in a liquid or milky lotion state and fibrous materials in a dry condition, however, it is relatively difficult to manufacture. More specifically, when the dispenser-containers are continuously manufactured, the wet fibrous materials are placed on the first sheet, and the second sheet is supplied over them, and then, the materials in a dry condition are placed on the second sheet in such manner that the materials in a dry condition overlie the wet fibrous materials, and further the third sheet is supplied over them so that the wet and dry contents are placed at spaces sandwiched by the three sheets, i.e., the first through third sheets, and the overlain three sheets are heat sealed to form dispenser-containers.

However, in such a manufacturing process, it is not easy to supply contents at spaces between the sheets. It is also not easy to transfer to the heat sealing station these contents, which are stacked with each other and sandwich the second sheet therebetween, while the third sheet is supplied onto the stacked contents and while the stacked contents are prevented from crumbling. Furthermore, the process requires delicate setting, controlling and adjusting of the heat sealing conditions, and the setting, controlling and adjusting are very troublesome.

Further, when contents of one type are impregnated with liquid therein, the impregnated liquid may leak out or flow out while the contents are transferred, and as a result, the leaked liquid may wet other kinds of contents and diminish the commercial value of the dispenser-container, or the portion to be heat sealed is wetted and cannot be easily sealed.

In addition, in the above described dispenser-container, relatively thick sheets are used so as to be impervious against gas, and the materials of the three sheets are the same so as to facilitate easy heat sealing. Accordingly, the cost of the sheets may be relatively expensive.

OBJECTS OF THE INVENTION

An object of the present invention is to provide a dispenser-container containing wet and dry contents, by which the above-described problems inherent is the prior art can be obviated, and the continuous manufacture of which can be done easily, and the manufacturing cost of which can be low.

Another object of the present invention is provide a process for continuously manufacturing such a dispenser-container.

SUMMARY OF THE INVENTION According to the present invention, the above-described problems are overcome by a dispenser-container containing wet and dry contents characterizied in that:

wet fibrous materials are contained in an inner container made of a gas impervious sheet;

the inner container has an opening for dispensing the wet fibrous materials therethrough or a weakened line for forming the opening;

the opening or weakened line is resealably covered by a flexible flap which is repeatedly attached to or removed from the inner container by means of a pressure sensitive adhesive;

both the inner container containing wet fibrous materials and materials in a dry condition are contained in an outer container while they are stacked with each other;

the outer container has a first opening or a first weakened line for forming the first opening formed in a first surface at a portion coinciding with the opening or the weakened line formed in the inner container; and the outer container has a second opening for dispensing the dry materials or a second weakened line for forming the second opening in a second surface opposite to the first surface having the first opening or the first weakened line.

According to the present invention, the above-described problems are overcome by the following three processes.

The first process is characterized by:

preparing inner containers for hermetically containing wet fibrous materials, materials in a dry condition, and a continuous sheet for packing the inner containers and the materials in a dry condition;

each inner container being made of a gas impervious sheet and having an opening for dispensing the wet fibrous materials therethrough or a weakened line for forming the opening and a flexible flap for covering the opening or the weakened line;

forming in the continuous sheet first openings for dispensing the wet fibrous materials therethrough or first weakened lines for forming the first openings at a predetermined distance, and forming in the continuous sheet at least one second opening for dispensing the materials in a dry condition or at least one second weakened line for forming the at least one second opening at a position parallel to the first openings or weakened lines;

supplying the inner containers and the materials in a dry condition onto the continuous sheet in such a manner that surfaces of the inner containers opposite to surfaces having the flaps are in contact with the materials in a dry condition and that the flaps of the inner containers are positioned coinciding with the first openings formed in the continuous sheet or the first weakened lines for forming the first openings;

wrapping the inner containers and the materials in a dry condition, which are stacked with each other, with the continuous sheet, sealing longitudinal edges of the continuous sheet with each other, sealing the continuous sheet in a transverse direction, and cutting the continuous sheet in a transverse direction at a predetermined distance so as to form individual dispenser-containers.

Another process is characterized by:

preparing inner containers for hermetically containing wet fibrous materials, materials in a dry condition, and a continuous sheet for packing the inner containers and the materials in a dry condition, each inner container being made of a gas impervious sheet and having an opening or a weakened line for forming the opening for dispensing the wet fibrous materials therethrough and a flexible flap for covering the opening or the weakened line;

forming in the continuous sheet first openings for dispensing the wet fibrous materials therethrough or first weakened lines for forming the first openings at a predetermined distance;

supplying the inner containers and the materials in a dry condition onto the continuous sheet in such a manner that surfaces of the inner containers opposite to surfaces having the flaps are in contact with the materials in a dry condition and that the flaps of the inner containers are positioned coinciding with the first openings formed in the continuous sheet or the first weakened lines for forming the first openings;

wrapping the inner containers and the materials in a dry condition, which are stacked with each other, with the continuous sheet, overlapping longitudinal edges of the continuous sheet with each other to form an opening for dispensing the materials in a dry condition, sealing said continuous sheet in a transverse direction, and cutting in a transverse direction at a predetermined distance so as to form individual dispenser-containers.

The remaining process is characterized by:

preparing inner containers for hermetically containing wet fibrous materials, materials in a dry condition, and a first continuous sheet and a second continuous sheet for packing the inner containers and the materials in a dry condition, each inner container being made of a gas impervious sheet and having an opening for dispensing the wet fibrous materials therethrough or a weakened line for forming the opening and a flexible flap for covering the opening or the weakened line;

forming in the first continuous sheet first openings for dispensing the wet fibrous materials therethrough or first weakened lines for forming the first openings at a predetermined distance, and forming in the second continuous sheet at least one second opening for dispensing the materials in a dry condition or second weakened lines for forming the at least one second opening;

supplying the inner containers and the materials in a dry condition into a space between the first and second continuous sheets in such a manner that surfaces of the inner containers opposite to surfaces having the flaps are in contact with the materials in a dry condition and that the flaps of the inner containers are positioned coinciding with the first openings formed in the first continuous sheet or the first weakened lines for forming the first openings;

sealing longitudinal edges of the first and second continuous sheets with each other while the inner containers and the materials in a dry condition are stacked with each other, and cutting the first and second continuous sheets in a transverse direction at a predetermined distance so as to form individual dispenser-containers.

BRIEF DESCRIPTION OF THE DRAWINGS

The present invention will now be explained in detail with reference to the accompanying drawings, wherein:

FIG. 6 through 11 are views illustrating alternative embodiments of the outer container, wherein FIG. 6 is a top plan view illustrating the top surface of the outer container, which surface contacts the outer surface of the inner container;

FIG. 7 is a top plan view similar to FIG. 6 and illustrating another embodiment;

FIG. 8 is a rear plan view illustrating another embodiment of the outer container;

FIG. 9 is a cross sectional view taken along line IX—IX in FIG. 8;

FIG. 10 is a rear plan view illustrating still another embodiment of the outer container;

FIG. 11 is a cross sectional view taken along line XI—XI in FIG. 10;

DESCRIPTION OF THE PREFERRED EMBODIMENTS

Figure 1:
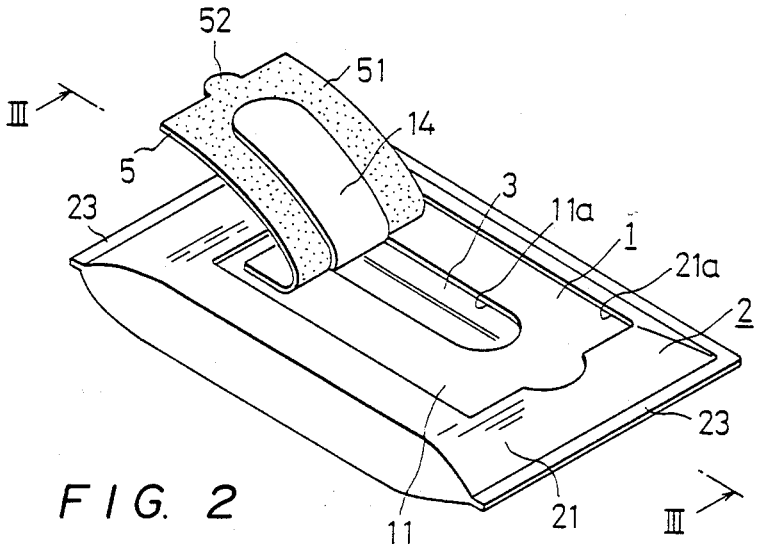
FIG. 1 is a perspective view of an embodiment of a dispenser-container containing wet and dry contents of the present invention.
Figure 2:
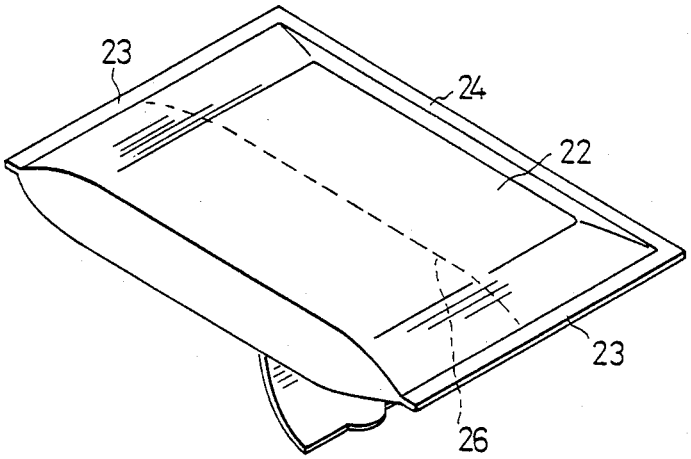
FIG. 2 is a perspective view showing the rear side of the dispenser-container containing wet and dry contents illustrated in FIG. 1.
Figure 3:
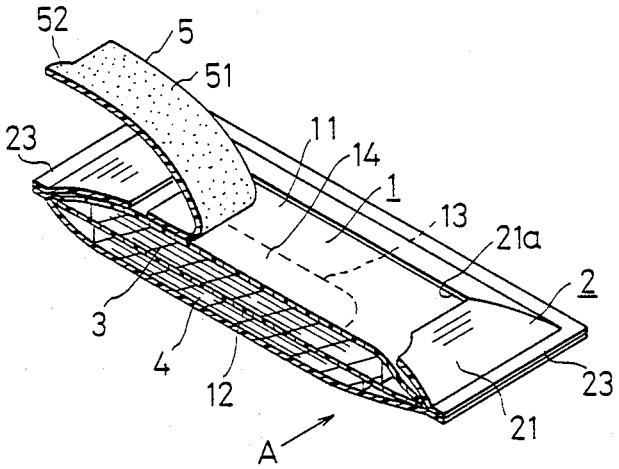
FIG. 3 is a cross sectional view taken along line III—III in FIG. 1 (wherein a weakened line for forming an opening remains uncut)

As illustrated in FIGS. 1-3, the dispenser-container containing wet and dry contents of the present invention comprises: an inner container 1 containing fibrous materials 3 impregnated with liquid, for example, a liquid or milky lotion type cosmetic, disinfectant, etc. (which materials will be referred to as wet fibrous materials); and an outer container 2 containing both the inner container 1 and materials 4 in a dry condition.

The liquid used to impregnate the wet fibrous materials is not limited as long as it is in a liquid state or it is an emulsion of sufficiently low viscosity to be pourable, such as a milky lotion For example, the liquid may be softening toilet water, freshening toilet water or cleaning toilet water, carmine lotion, moisture lotion, disinfectant and so on.

Soft non-woven fabrics, cut cotton layers for toilet use, gauze, absorbent cotton, and so on may be used for the wet fibrous materials.

Soft non-woven fabrics, cut cotton layers for toilet use, gauze, tissue papers, band-aids and so on may be used for the materials in a dry condition.

In the embodiment illustrated in FIGS. 1 through 5, the inner container 1 is made of an impervious sheet which prevents gas and liquid from escaping and is substantially flat. Thus, c hermetically contains the wet fibrous materials.

The gas impervious sheet may be a film made of synthetic resin such as polyethylene, polypropylene, polyamide, polyester, and polyvinyl chloride, and the film may be a single layer or a laminated layer. The film may be a laminated layer of the above-mentioned film and an aluminum sheet.

The inner container 1 has a perforated line 13 formed in the (outer) surface 11 thereof contacting the outer container 2; and a flap 5 made of a flexible sheet-like material similar to the material of the inner container 1 and covering the perforated line 13.

The flap 5 has a pressure sensitive adhesive 51 applied to the inside surface thereof, i.e., the side contacting the outer surface 11 of the inner container 1, except for a grip portion 52. Due to the pressure sensitive adhesive 51, the flap can be repeatedly adhered to and removed from the inner container 1.

Before use, the perforated line 13 is covered by the flap 5. Once the flap 5 is taken up from the inner container 1, the portion 14 surrounded by the perforated line 13 is removed from the inner container 1 and is adhered to the pressure sensitive adhesive 51 as illustrated in FIG. 1. Accordingly, the space formed by the removal of the portion 14 is used as an opening 11*a* for dispensing the wet fibrous materials 3.

With perforated line 13, the user is assured that nobody has taken the contents out of the inner container 1 before the user uses it. Instead of the perforated line 13, a hole may be formed in the inner container for dispensing the wet fibrous materials 3.

The outer container 2 is a package simultaneously containing the inner container 1 and the materials 4 in a dry condition, the material of the outer container 2 may be a single layered or laminated layered film made of the same synthetic resins as mentioned-above in connection with the material of the inner container 1, or cellophane. Since impervious ability against gas and liquid is not required for the outer container 2, a sheet-like material having a thickness thinner than that of the inner container 1 can be used for the outer container 2.

As illustrated in FIG. 3, the inner container 1 and the materials 4 in a dry condition are stacked with each other in such a manner that the inner surface 12, i.e., the surface opposite to the surface 11 having the perforated line 13, contacts the materials 4 in a dry condition, and materials 4 are contained in the outer container 2.

Figure 4:
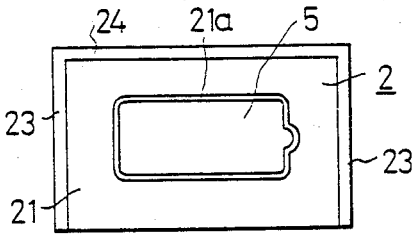
FIG. 4 is a top plan view showing one side of the dispenser-container containing wet and dry contents illustrated in FIG. 1.

As illustrated in FIGS. 1 and 4, an opening 21*a* is formed in the surface 21 of the container 2, which surface contacts outer surface 11 of the inner container 1, at a portion corresponding to the flap 5 attached to the inner container 1. Accordingly, if the flap 5 of the inner container 1 is opened at the opening 21*a* as illustrated in FIG. 1, the wet fibrous materials 3 can be removed through the opening 11*a* of the inner container 1.

Figure 5:
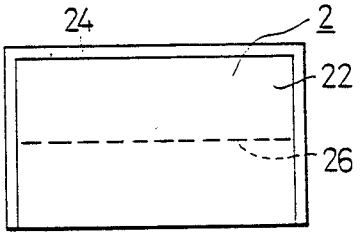
FIG. 5 is a rear plan view showing the side opposite to that illustrated in FIG. 4.

As illustrated in FIGS. 2 and 5, a perforated line 26 is formed in the surface 22 of the outer container 2 opposite to the surface 21 and will be used to form an opening for dispensing the materials 4 in a dry condition. An opening may be formed instead of the perforated line 26. However, the perforated line is preferable, because the outer container 2 assures a user that nobody has taken the contents out of the outer container before the user uses it.

The outer container 2 is a three sided seal package formed by heat sealing the edges 23 and a longitudinal side edge 24.

Upon use of the above-described dispenser-container containing wet and dry contents, if the wet fibrous materials 3 are desired to be taken out, the grip portion 52 of the flap 5 is pulled up to open the opening 11*a* of the inner container 1, and the wet fibrous materials 3 are taken out through the opening 11*a*. Then, the opening 11*a* is covered by the flap 5. If the materials 4 in a dry condition are desired to be removed, the dispenser-container containing wet and dry contents is first turned upside down, an opening is formed along the perforated line 26, and then the materials 4 in a dry condition are taken out.

Various alternative embodiments of the outer container 2 are illustrated in FIGS. 6 through 11.

Figure 6:
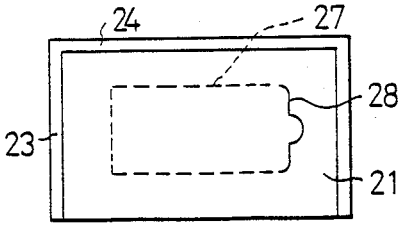

FIG. 6 is a plan view illustrating the surface 21 of the outer container 2, which surface contacts the outer surface 11 of the inner container 1. The illustrated embodiment has a perforated line 27 and a continuous punched line 28 connected to the perforated line 27, which are formed instead of the opening 21*a*. The two kinds of lines 27 and 28 form a closed loop.

Upon use, the continuously punched portion 28 is gripped by means of fingers and is pulled up along the perforated line 27, the portion encircled by the closed loop is removed from the main body of the outer container 2, and an opening is formed. Thus, the outer container is then in a condition similar to that illustrated in FIG. 4. Accordingly, if the flap 5 of the inner container 1 is opened through the thus formed opening, the wet fibrous materials 3 can be removed through the opening 11*a* formed in the inner container 1.

In the embodiment illustrated in FIG. 6, the outer container 2 per se has a sealing function, i.e., the user is assured that nobody has taken the contents out of the outer container 2 before the user uses it. Accordingly, the inner container 1 is not required to have such a sealing function. Therefore, the embodiment illustrated in FIG. 6 is suitable for containing a inner container 1 having an hole for dispensing the wet fibrous materials 3 in place of a perforated line 13 illustrated in FIG. 3.

Figure 7:
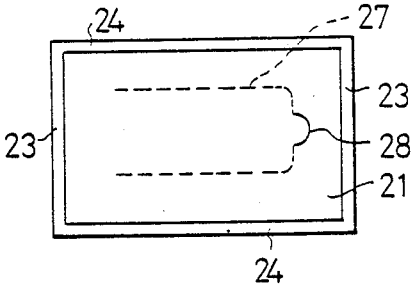

FIG. 7 is similar to FIG. 6 and is a plan view illustrating the surface 21 of the outer container 2, which surface contacts the outer surface 11 of the inner container 1. In the embodiment illustrated in FIG. 7, similar to that illustrated in FIG. 6, a perforated line 27 and a continuous punched line 28 connected to the perforated line 27 are formed instead of the opening 21*a*. Different from the embodiment illustrated in FIG. 6, the two kinds of lines 27 and 28 draw a U-shaped open loop. Accordingly, even if the perforated line 27 is cut, the portion surrounded by the open loop is not removed from the main body of the outer container 2. Further, the continuously punched line 28 in FIG. 7 is so short that only the fingers can grip it, and the line 28 is prevented from being erroneously opened, while the continuously punched line 28 in FIG. 6 is relatively long to facilitate easy removal of the closed loop portion.

Further, unlike the embodiment illustrated in FIG. 1, in the embodiment illustrated in FIG. 7, the dispenser-container containing wet and dry contents is a four sided seal package wherein all the peripheries 23 and 24 of the outer container 2 are heat sealed. The process for manufacturing this dispenser-container will be explained later with reference to FIG. 24.

Figure 8:
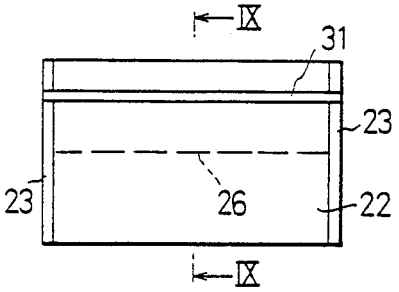
Figure 9:
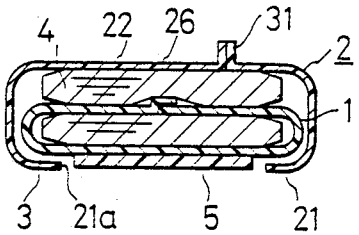

FIG. 8 is a rear view illustrating another embodiment of the outer container 2, and FIG. 9 is a cross sectional view taken along line IX—IX in FIG. 8. The outer container 2 of this embodiment is formed in a pillow type package. The dispenser-container containing wet and dry contents of this embodiment has heat sealed portions 23 at the edges and a longitudinal heat sealed portion 31 on the surface 22 which contacts the materials 4 in a dry condition. On the surface 22, the longitudinal sealed portion 31 is located at a position deviating a small distance from the center, and a perforated line 26 which will be used to form an opening for dispensing the materials 4 in a dry condition therethrough is located at the center. FIG. 9 illustrates an embodiment which has an opening 21*a* formed in the front surface 21 of outer container 2 as shown in the first embodiment, however, a perforated line 27 or 28 may be formed instead of the opening as shown in the embodiments illustrated in FIGS. 6 and 7.

Figure 10:
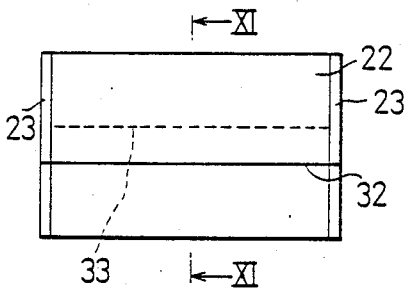
Figure 11:
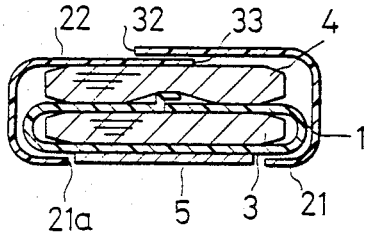

FIG. 10 is a rear view of another embodiment of the outer container 2, and FIG. 11 is a cross sectional view taken along line XI—XI in FIG. 10. The outer container 2 of this embodiment is of a pillow configuration. However, only the edges 23 are sealed, and there is no longitudinal heat sealed portions. In other words, the longitudinal edges 32 and 33 overlap with each other at the side 22 contacting the materials 4 in a dry condition, as clearly illustrated in FIG. 11. Accordingly, the portion between the longitudinal edges 32 and 33 serves the function of an opening for dispensing the materials 4 in a dry condition, and the materials 4 in a dry condition can be removed therethrough.

Similar to FIG. 9, FIG. 11 illustrates an embodiment wherein an opening 21*a* is formed in the outer surface 21 of the outer container 2, however, a perforated line 27 or 28 may be formed as illustrated in FIGS. 6 or 7.

In the above-described embodiments, if the size of the outer container 2 is selected such that it just wraps around the inner container 1 and the materials 4 in a dry condition, the positional relationship of the flap 5 of the inner container 1 and the opening 21*a* or the weakened lines 27 or 28 of the outer container 2 will not be changed. It is preferable to provide a means for fixing the positional relationship between the inner container 1 and the outer container 2 in order to completely prevent any change in the positional relationship between the flap 5 of the inner container 1 and the opening 21*a* or the weakened lines 27 or 28 of the outer container 2 from occurring.

Figure 12:
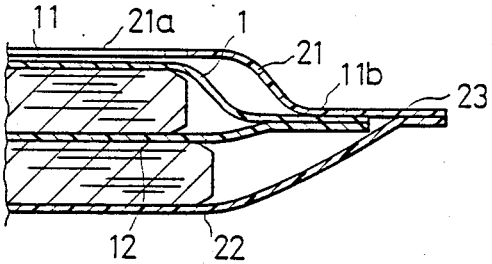
FIG. 12 is a cross sectional view showing a part of an embodiment of a dispenser-container containing wet and dry contents of the present invention.

In the embodiment illustrated in FIG. 12, parts of the heat sealed portions 23 at the edges of the outer container 2 are attached to parts of the heat sealed portions 11*b* at the edges of the inner container 1 by means of heat sealing. This can be done as follows. For example, when the outer container 2 is packed while the inner container 1 and the materials 4 in a dry condition are wrapped, the heater used for heating the surface 21 of the outer container 2 is widened so that the edges 11*b* of the surface 11 of the inner container 1 are simultaneously heated, and then, the edges 11*b* of the surface 11 of the inner container 1 and the surface 21 of the outer container 2 are thermally attached together.

Figure 13:
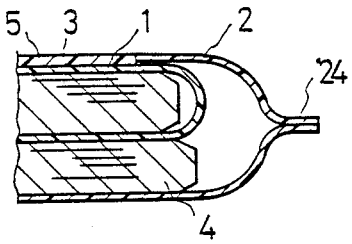
FIG. 13 is a cross sectional view showing a part of a dispenser-container containing wet and dry contents before an outer container is shrunk.
Figure 14:
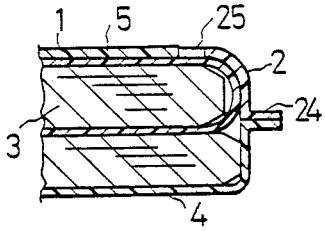
FIG. 14 is a cross sectional view showing the part of the dispenser-container containing wet and dry contents after the outer container is shrunk.

In another fixing method, an outer container 2 of a shrink dispenser-container containing wet and dry contents may be used. As illustrated in FIGS. 13 and 14, a film which can be shrunk by heat is first used to form a dispenser-container containing wet and dry contents by wrapping both an inner container 1 and materials 4 in a dry condition (FIG. 13), and then, the dispenser-container containing wet and dry contents is heated in a shrink tunnel so as to shrink the outer container 2 (FIG. 14). As a result, the outer container 2 tightly contacts the inner container 1 and the materials 4 in a dry condition. Accordingly, the change of the positional relationship between the inner container 1 and the outer container 2 is prevented from occurring.

In this case, it is preferable that a uniaxial oriented film is used so that it shrinks only in a transverse direction or a longitudinal direction of the dispenser-container containing wet and dry contents. As a result, the outer container 2 shrinks only in one direction, and accordingly, the position of the opening 21*a* or the weakened lines 27 or 28 of the outer container becomes approximately constant after the dispenser-container containing wet and dry contents is shrunk. Accordingly, when the outer container 2 is shrunk, it is assured that the positional relationship between the flap 5 of the inner container 1 and the opening or weakened line of the outer container will coincide with each other.

Figure 15:
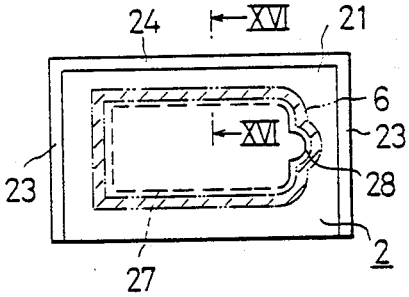
FIG. 15 is a top plan view of another embodiment.
Figure 16:
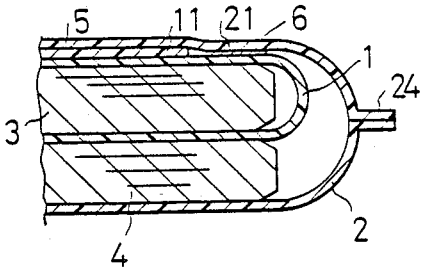
FIG. 16 is a cross sectional view taken along line XVI—XVI in FIG. 15.

FIG. 15 shows another embodiment which is used to explain a fixing means, and FIG. 16 is a cross sectional view taken along line XVI—XVI in FIG. 15. In this embodiment, the inner container 1 and the outer container 2 are attached to each other by means of an adhesive 6, such as a pressure sensitive adhesive. The adhesive 6 may be applied to any portion as long as the surface 11 of the inner container 1 and the surface 21 of the outer container 2 are in contact with each other at the portion, and the adhesive may be applied to the inner container 1 or the outer container 2. It is preferable that the adhesive is applied to a portion around an opening or a weakened line 27 or 28 of the outer container 2 by, for example, printing.

Some embodiments of the inner container 1 contained in the outer container 2 will now be explained with reference to FIGS. 17 through 20.

Figure 17:
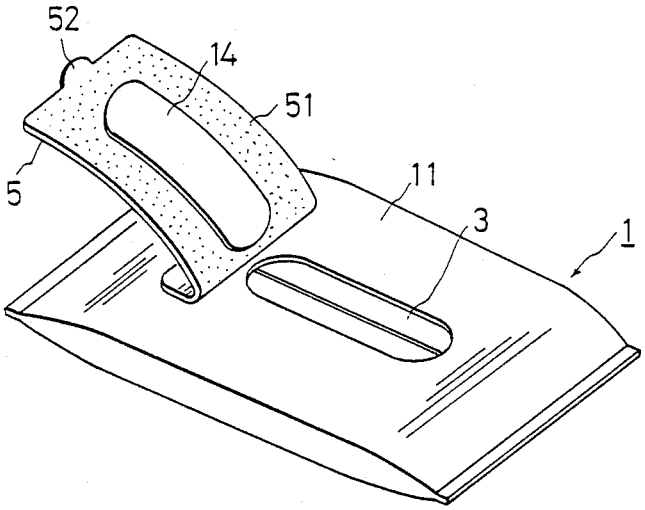
FIGS. 17 and 18 are perspective views illustrating different embodiments of the inner container.

The inner container illustrated in FIG. 17 is a package of a pillow configuration. The constructions of the flap 5 and the opening are substantially the same as those illustrated in FIG. 3. More specifically, a perforated line drawn in a closed loop (which corresponds to that designated by 13 in FIG. 3) is formed in the surface 11 of the inner container 1, and a flap having a pressure sensitive adhesive 51 applied thereto is attached to the surface 11. When the flap 5 is taken up, the portion 14 surrounded by the perforated line is removed from the inner container 1 and is adhered to the pressure sensitive adhesive 51. Accordingly, an opening 11*a* is formed for dispensing the wet fibrous materials 3.

Figure 18:
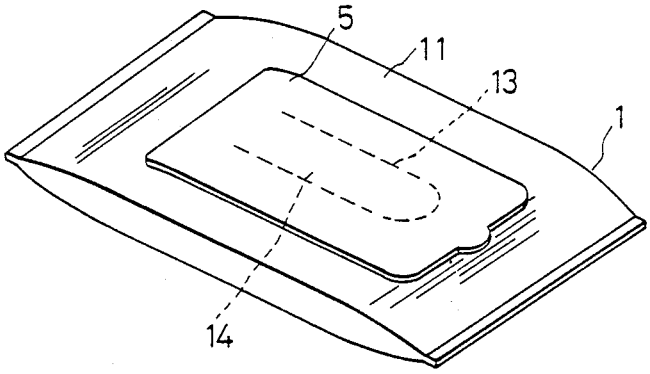

The inner container 1 illustrated in FIG. 18 has a construction substantially the same as that illustrated in FIG. 17, however, a perforated line drawn in a U-shape is formed in place of the perforated line drawn in a closed loop. The pressure sensitive adhesive is similarly applied to the inner side of the flap 5. When the flap is opened, the portion surrounded by the perforated line drawn in a U-shape is removed from the main body of the inner container 1, while one end of the flap remains connected to the main body.

Figure 19:
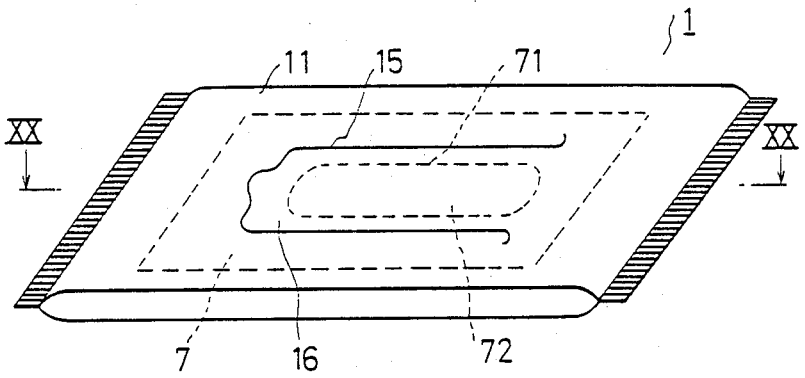
FIG. 19 is a perspective view illustrating an inner container of another type.
Figure 20:
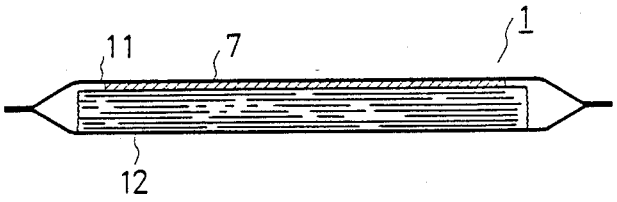
FIG. 20 is a cross sectional view taken along line XX—XX in FIG. 19.

FIG. 19 is a perspective view illustrating an inner container of another type, and FIG. 20 is a cross sectional view taken along line XX—XX in FIG. 19. In this embodiment, a sheet 7 having a pressure sensitive adhesive applied to the upper surface thereof is located inside of the inner container 1 and is attached to the rear side of the surface 11 of the inner container 1. A continuous weakened line 15 is formed in the surface 11 of the inner container 1, and the ends of the weakened line 15 are formed in an arc. Upon use, when the weakened line 15 is taken up, the portion 72 surrounded by the closed loop 71 in the sheet 7 is removed together with the portion 16 surrounded by the weakened line 15 in the inner container 1 while it is adhered to the latter. The space in the sheet 7 formed by the removal of the portion 72 surrounded by the closed loop 71 is used as an opening for dispensing the wet fibrous materials 3, and the portion 16 in the inner container surrounded by the weakened line 15 serves as a flap.

Each inner container 1 illustrated in FIGS. 17 through 20 is of a pillow type, however, a three sided seal package or a four sided seal package may be used as an inner container.

Figure 21:
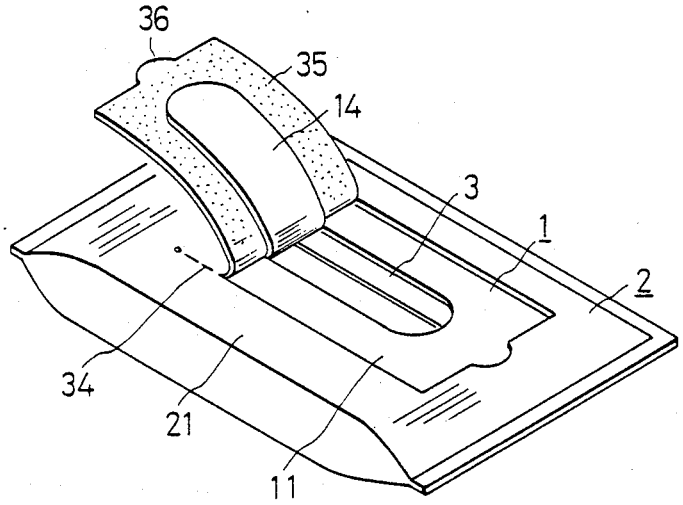
FIG. 21 is a perspective view of another embodiment of the dispenser-container of the present invention.

In all the embodiments described above, a flap is attached to the inner container or is formed by a part of the inner container 1. Contrary to this, in the embodiment illustrated in FIG. 21, a flap is not attached to the inner container, but a flap is formed by a part of the surface of the outer container 2.

Figure 22:
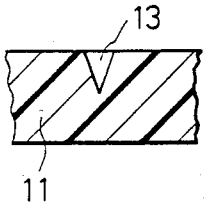
FIG. 22 is a cross sectional view of a part of the sheet of the inner container.

More specifically, a punching line 13 is formed in the surface 11 contacting the outer container to a depth half of the thickness of the sheet as illustrated in FIG. 22 in place of the perforated line, and said punching line will be referred to as a "half punching line" hereinbelow. A U-shaped perforated line 34 is formed at a portion of surface 21 corresponding to the half punching line 13, and a pressure sensitive adhesive 35 is applied to the inside of the surface 21 of the outer container 2, which surface contacts the inner container 1. It is preferable that a part 36 of the inside of the surface 21 remains uncoated with the pressure sensitive adhesive so as to form a gripping portion and so as to facilitate easy pulling of the portion surrounded by the U-shape in the outer container 2.

According to this embodiment, during the manufacturing process of the dispenser-container containing wet and dry contents of the present invention, the bottom of the half punching line 13 does not reach the inside of the inner container 1, and accordingly, the inner container 1 can be hermetically sealed against gas or liquid, even if it is not provided with a flap.

Upon use of the dispenser-container of the present invention, the portion surrounded by the U-shaped perforated line 34 in the outer container 2 is taken up, the portion 14 in the inner container surrounded by the punching line 13 is pulled up together therewith and is removed from the inner container 1, and the space formed by removal is used as an opening for dispensing wet fibrous materials 3.

It is noted that the inner container 1 is not limited to the embodiments described above. Any conventional known package may be used as an inner container as long as it is made of a gas impervious sheet and has an opening for dispensing the wet fibrous materials therethrough or a weakened line for forming the opening, and as long as the opening or weakened line can be resealably covered by a flexible flap, which is capable of being repeatedly opened and closed.

Figure 23:
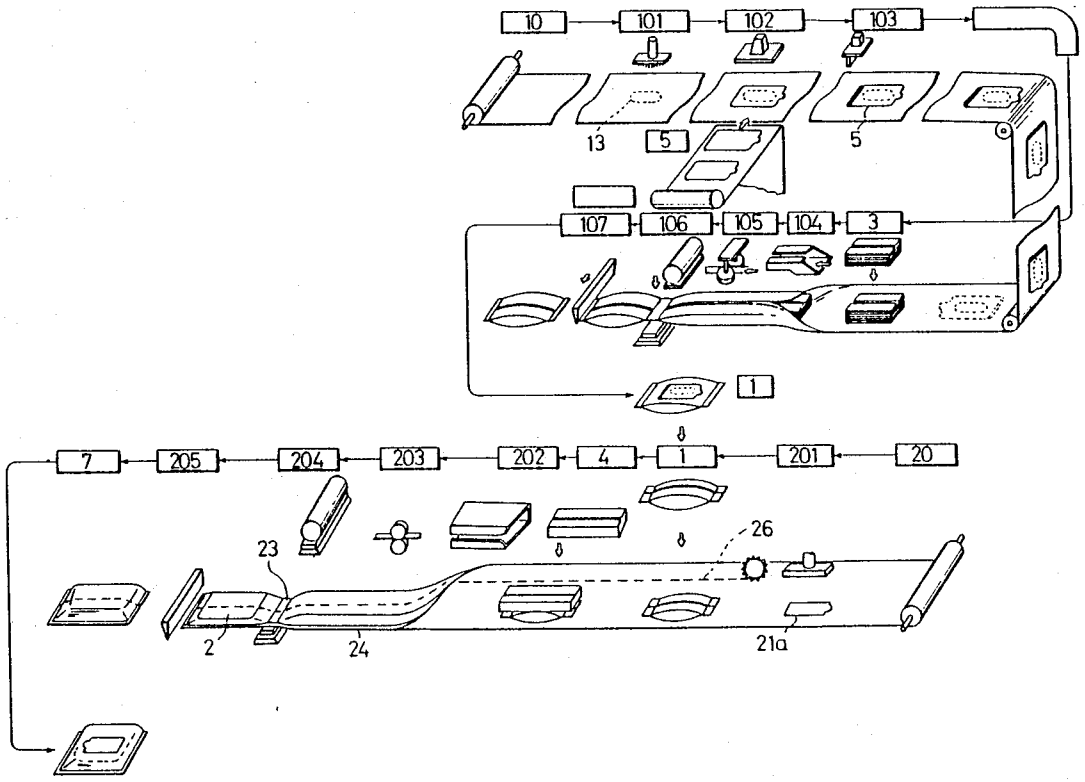
FIGS. 23, 24 and 25 are flow diagrams of embodiments of manufacturing processes according to the present invention, respectively.

FIG. 23 is a flow diagram of an embodiment of a process according to the present invention for manufacturing dispenser-containers illustrated in FIGS. 1 through 5.

First, inner containers 1 containing wet fibrous materials 3 are prepared, and materials in a dry condition, which were described above are also prepared.

FIG. 23 illustrates an embodiment of a process for manufacturing the inner containers 1 which have a construction similar to that illustrated in FIG. 17. In this embodiment, perforated lines 13 are formed at positions, where openings will be formed, in the gas impervious sheet 10 used for forming the inner container 1, by means of a press 101, and thereafter, flaps 5 are attached to the gas impervious sheet 10 by means of a labeler 102 or by a human hand so as to cover the perforated lines 13 formed in the gas impervious sheet 10.

The flap 5 has a pressure sensitive adhesive 51 applied to the surface contacting the gas impervious sheet 10 except for a grip portion 52, as illustrated in FIG. 3. It is preferable that one end of the flap 5 is fixed to the sheet 10 by means of a heat sealer 103, as illustrated in FIG. 23. As described above, the inner containers 1 are prepared first.

Wet fibrous materials 3 are placed on the perforated line 13 on the surface opposite to the surface where the flaps 5 are attached. Then, the wet fibrous materials 3 are wrapped by means of a packaging apparatus which comprises a guide member 104, center heat sealer 105 and a transverse heat sealer 106. The sheet 10 is cut in a transverse direction by means of a cutter 107 to form individual dispenser-containers, and thus inner container 1 containing the wet fibrous materials 3 is obtained.

In place of the perforated line drawn in a closed loop, in FIG. 23, an opening may be formed by completely punching the gas impervious sheet by means of a press 101, or a perforated line may be formed in a U-shape so as to form an inner container as illustrated in FIG. 18.

Other types of inner containers, such as illustrated in FIG. 19, may be manufactured in the following methods.

A weakened line of an open loop, for example, of a U-shape, is formed in the gas impervious sheet. A piece of sheet, which has a perforated line formed in a closed loop and a pressure sensitive adhesive applied on one side thereof, is attached to the surface of the gas impervious sheet which is inside of the inner container in such a manner that it covers the open looped weakened line formed in the gas impervious sheet for an inner container. Wet fibrous materials are placed on the piece of sheet, and then, they are wrapped and packed by the gas impervious sheet.

The inner container 1 illustrated in FIG. 1, is of a pillow type configuration, however, a three sided seal package or four sided seal package may be used as an inner container.

It is noted that the inner container is not limited to those described above. Any conventionally known package may be used as an inner container as long as it is made of a gas impervious sheet and has an opening for dispensing the wet fibrous materials therethrough or a weakened line for forming the opening, and as long as the opening or weakened line can be covered by a flexible flap, which is capable of being repeatedly opened and closed.

It is preferable that the size of the materials in a dry condition is almost the same as the size of the wet fibrous materials so as to facilitate their easy stacking. If the materials in a dry condition are, for example, band-aids, which are used as small individual pieces, it is preferable that a group of band-aids are connected together having perforated lines therebetween so as to be able to be individually cut rather than individually packing the same. Further, if the materials in a dry condition are made of a sheet-like material such as a tissue paper, it is preferable that the sheet-like materials are folded in a size harmonizing with the size of the inner container containing wet fibrous materials.

Then, both the inner containers 1 and the materials in a dry condition 4 are wrapped by the outer container 2, as illustrated in FIG. 1. More specifically, openings **21*a* for dispensing the wet fibrous materials are formed at a predetermined distance on a continuous sheet 20 used for the outer containers 2 by means of a press 201**.

Together with the formation of the openings **21*a*, a perforated line 26 is formed so that it extends in a longitudinal direction of the continuous sheet 20 and it is parallel to the openings 21*a***.

The inner containers 1 are placed on the continuous sheet 20. In this case, they are directed so that the flaps 5 of the inner containers 1 are located at the underside of the inner container and are made coincident with the openings **21*a* formed in the continuous sheet 20**.

The materials in a dry condition 4 are supplied onto the inner containers 1.

The continuous sheet 20 is guided by a guide member 202, and the inner containers 1 and the materials in a dry condition 4 are wrapped by the continuous sheet 20 while they are stacked with each other. A heat sealer 203 seals the longitudinal edges 24 of the continuous sheet 20. Then, a transverse heat sealer 204 transversely heat seals the continuous sheet 20 at the portion 23, and forms an outer container connected to the continuous sheet 20 at the heat sealed portions 23.

A cutter 205 transversely cuts the heat sealed portions 23 or the portions near the heat sealed portions 23 to form individual dispenser-containers 7.

Furthermore, in place of the formation of the perforated line 26 extending in the longitudinal direction of the continuous sheet 20, openings may be formed at a portion parallel to the openings **21*a* in a suitable shape, for example, a length of perforated lines or a length of slits, so as to use for dispensing the materials in a dry condition 4** therethrough.

With respect to the supply of the inner container 1 and the materials in a dry condition 4 onto the continuous sheet 20, in FIG. 4, the inner container is supplied prior to the materials in a dry condition 4. However, contrary to this, the materials in a dry condition 4 may be placed first on the perforated line 26 corresponding to the opening **21*a*, and then, the inner container 1 is placed on the materials in a dry condition 4**, and thereafter, they may be wrapped by the continuous sheet.

The outer container 2 of the embodiment illustrated in FIGS. 8 and 9 may be manufactured as follows. In the manufacturing process illustrated in FIGS. 23, the positions of openings 21*a* and the perforated line 26 formed in the continuous sheet 20 are displaced a small distance in a transverse direction of the continuous sheet 20, and the longitudinal seal by the heat sealer 203 is performed at a position near the center of the width of the outer container 2.

Figure 24:
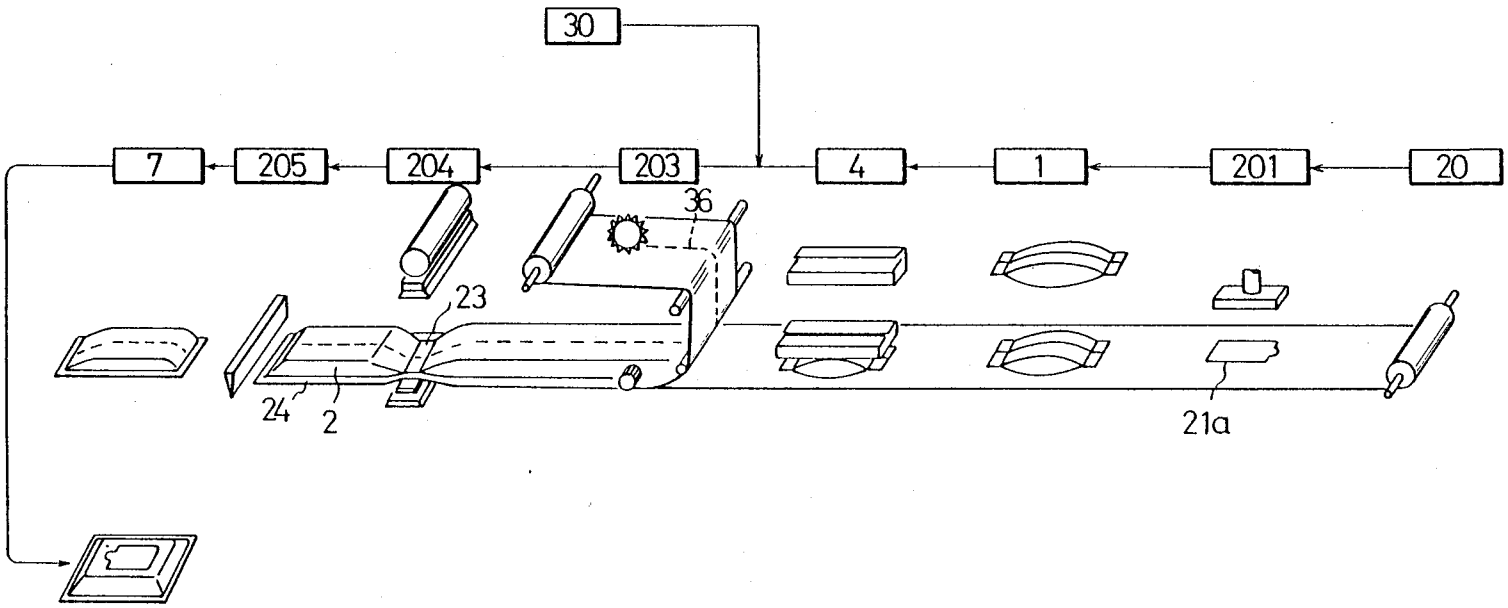

FIG. 24 is a flow diagram of a process of the present invention for manufacturing such a four sided seal package as illustrated in FIG. 7.

Also in this embodiment, an inner container 1 and materials in a dry condition 4 are previously prepared similar to the case in the embodiment illustrated in FIG. 23.

An outer container 2 consists of two continuous sheets, and openings 21*a* for dispensing the wet fibrous materials are formed in a first continuous sheet 20 by means of a press 201 at an approximately center of the width of the first continuous sheet 20 and at a predetermined distance in a longitudinal direction of the first continuous sheet. In place of the openings 21*a*, a perforated line or a weakened line 27 or 28 as shown in FIG. 6 or 7 may be formed.

The inner containers 1 are placed on the continuous sheet 20 in such a manner that the flaps 5 of the inner containers 1 are located at the underside of the inner containers 1 and are made coincident with the openings 21*a* formed in the first continuous sheet 20.

Then, the materials in a dry condition 4 are supplied onto the inner containers 1, and a second continuous sheet 30 is guided over them.

In the second continuous sheet 30, openings are formed in parallel with the openings 21*a* for dispensing the materials in a dry condition therethrough or weakened lines are formed for forming the openings, such as a perforated line 36 extending in the longitudinal direction of the second continuous sheet 30, or a length of slits.

The inner container 1 and the materials in a dry condition 4 overlap each other and are sandwiched by the first and second continuous sheets 20 and 30.

The following alternative embodiments are possible. The materials in a dry condition 4 are supplied onto the second continuous sheet 30, and then, the inner containers 1 are placed on the materials in a dry condition 4 in such a manner that the flaps 5 of the inner containers 1 are directed upwardly, and thereafter, the first continuous sheet 20 is supplied onto them. Also in this case, the inner containers 1 should be placed on the materials in a dry condition 4 in such a manner that the flaps 5 are made coincident with the openings 21*a* formed in the first continuous sheet 20.

A heat sealer 203 seals the longitudinal edges of the first and second continuous sheets 20 and 30 to form heat sealed portions 24.

Then, a transverse heat sealer 204 transversely heat seals the continuous sheets 20 and 30, and forms an outer container with heat sealed portions 23.

It is possible that the longitudinal edges are heat sealed after the transverse seal has been conducted.

A cutter 205 transversely cuts the heat sealed portions 23 or the portions near the heat sealed portions 23 to form individual dispenser-containers 7.

Figure 25:
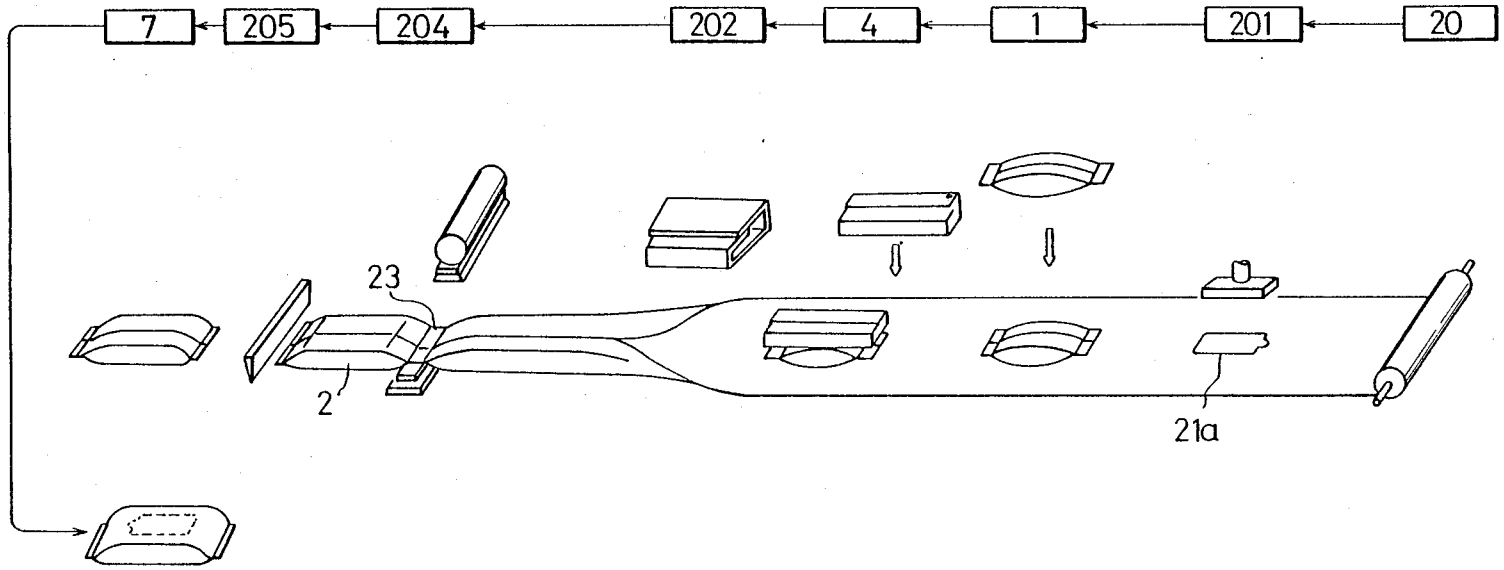

FIG. 25 is a flow diagram of another embodiment of a manufacturing process according to the present invention for manufacturing a dispenser-container illustrated in FIGS. 10 and 11.

Also in this embodiment, inner containers 1 and materials in a dry condition 4 are previously prepared similar to the the embodiment illustrated in FIG. 23.

Openings 21*a* for dispensing the wet fibrous materials are formed in a continuous sheet 20 used for the outer container 2 by means of a press 201 at an approximate center of the width of the continuous sheet 20 and at a predetermined distance in a longitudinal direction of the continuous sheet. In place of the openings 21*a*, a perforated line or a weakened line 27 or 28 as shown in FIGS. 6 or 7 may be formed.

The inner containers 1 are placed on the continuous sheet 20 in such a manner that the flaps 5 of the inner containers 1 are located at the underside of the inner containers 1 and are made coincident with the openings 21*a* formed in the continuous sheet 20.

Then, the materials in a dry condition 4 are supplied onto the inner containers 1.

The continuous sheet 20 is guided by the guide member 202 which wraps both the inner containers 1 and the materials in a dry condition 4 while they are stacked with each other. Although the longitudinal edges 24 of the continuous sheet 20 are gathered together and are overlapped, they are not heat sealed in this embodiment.

Then, a transverse heat sealer 204 transversely heat seals the continuous sheet 20 and forms an outer container connected to the continuous sheet 20 at heat sealed portions 23.

A cutter 205 transversely cuts the heat sealed portions 23 or portions near the heat sealed portions 23 to form individual dispenser-containers 7.

The dispenser-container of the present invention is suitable for containing wet fibrous materials together with materials in a dry condition, and it is very compact and portable.

According to the process of the present invention, a dispenser-container containing wet and dry contents can be easily and continuously manufactured. More specifically, contents in a wetted condition are packed first in an inner container, and then, an outer container is used to pack both the inner contents and the wet fibrous materials.

Accordingly, when the inner container and the materials in a dry condition are packed by the outer container, the inner container can be treated like the usual dry contents. Therefore, the packing process comprising supplying, transferring and wrapping steps can be simplified.

Furthermore, according to the present process, the liquid contained in the wet fibrous materials does not leak out during the wrapping step by the outer container. Therfore, the liquid does not wet the materials in a dry condition, and the commercial value of the dispenser is not diminished. In addition, the portion to be heat sealed is not wetted and can be easily heat sealed.

Furthermore, according to the dispenser-container containing wet and dry contents, a relatively thick sheet is used for the inner container so as to be impervious against gas and liquid, however, the sheet for the outer container can be relatively thin. As a result, the cost of the sheets used for the whole dispenser-container containing wet and dry contents can be minimized. In addition, if the outer container is heat sealed while it is overlapped with the heat sealed portions of the inner container as illustrated in FIG. 12, the heat sealing step can be surely conducted because the thermal energy can be transferred through a thin film.

As described above, the dispenser-container containing wet and dry contents of the present invention is easy to manufacture and can be continuously manufactured, and the cost of sheets can be low. As a result, the products of low price can be presented.

I claim:

1. A dispenser-container containing wet fibrous materials and dry materials separated from each other, comprising:

an inner container made of a gas impervious material and containing said wet fibrous materials;

said inner container including one of a first opening and a first weakened line for forming said first opening, to permit dispensing of said wet fibrous materials therethrough;

a flexible flap for releasably covering said first opening, and including a pressure sensitive adhesive which permits said flap to be repeatedly attached to and removed from said inner container;

an outer container containing both said inner container and said dry materials stacked together;

said outer container including a first surface having one of a second opening and a second weakened line for forming said second opening, at a position corresponding with said first opening; and said outer container including a second, opposite surface having one of a third opening and a third weakened line for forming said third opening, to permit dispensing of said dry materials therethrough.

2. A dispenser-container according to claim 1, wherein said first weakened line is formed as a closed loop surrounding a portion of one surface of said inner container, and said one portion is completely removed from said inner container to form said first opening.

3. A dispenser-container according to claim 1, wherein said first weakened line is formed in a substantially U-shaped configuration in surrounding relation to a first portion of one surface of said inner container, and said portion of said one surface of said inner container is only partially disengaged from said inner container to form said first opening.

4. A dispenser-container according to claim 1, wherein said outer container includes opposite longitudinal edges which are heat sealed, and opposite transverse edges which are heat sealed.

5. A dispenser-container according to claim 1, wherein said outer container includes opposite transverse edges which are heat sealed, and said second, opposite surface thereof includes opposing longitudinal edges offset from said third opening and which are heat sealed.

6. A dispenser-container according to claim 1, wherein said second, opposite surface includes opposing longitudinal ends which overlap each other and form said third opening.

7. A dispenser-container according to claim 1, wherein said inner container is adhered to an inner wall of said outer container for maintaining accurate alignment between said first opening and second opening.

8. A dispenser-container according to claim 7, wherein aherence of said inner container to said inner wall of said outer container maintains respective accurate alignment between said first opening, second opening, third opening and said wet fibrous materials and dry materials.

9. A dispenser-container according to claim 7, wherein said inner container is adhered to said inner wall by a heat seal.

10. A dispenser-container according to claim 9, wherein said inner container is adhered to said inner wall of said outer container by an adhesive.

11. A dispenser-container according to claim 1, wherein said outer container is made of a heat shrinkable material which is shrunk to provide accurate alignment of said first opening and said second opening.

* * * * *